US009656364B2

(12) United States Patent
Ryan et al.

(10) Patent No.: US 9,656,364 B2
(45) Date of Patent: May 23, 2017

(54) METHOD AND FIXTURE FOR ATTACHING A SANDING DISC TO A HAND SANDER

(71) Applicants: Honda Motor Co., Ltd., Tokyo (JP); Tool Technologies by Van Dyke, LLC, Marysville, OH (US); Starcke Abrasives USA, Inc., Charlotte, NC (US)

(72) Inventors: Cheryl Ann Ryan, Cable, OH (US); Anthony Mudd, Louisville, KY (US); Steven Ray Van Dyke, Marysville, OH (US); Jerry Douglas Horn, Hebron, KY (US)

(73) Assignees: Honda Motor Co., Ltd., Tokyo (JP); Tool Technologies by Van Dyke, LLC, Marysville, OH (US); Starcke Abrasives USA, Inc., Charlotte, NC (US)

( * ) Notice: Subject to any disclaimer, the term of this patent is extended or adjusted under 35 U.S.C. 154(b) by 85 days.

(21) Appl. No.: 14/332,644

(22) Filed: Jul. 16, 2014

(65) Prior Publication Data

US 2015/0020369 A1 Jan. 22, 2015

Related U.S. Application Data

(60) Provisional application No. 61/846,758, filed on Jul. 16, 2013.

(51) Int. Cl.
*B24B 23/00* (2006.01)
*B25B 11/02* (2006.01)
(Continued)

(52) U.S. Cl.
CPC ..... *B24B 23/005* (2013.01); *B24D 9/085* (2013.01); *B25B 11/02* (2013.01); *B25H 1/02* (2013.01);
(Continued)

(58) Field of Classification Search
CPC ..... B24B 23/005; B24B 23/02; B24B 23/04; B24B 45/00–45/006; B24D 9/085;
(Continued)

(56) References Cited

U.S. PATENT DOCUMENTS 2,708,224 A 5/1955 Rittenhouse
3,854,206 A 12/1974 Hutchins
(Continued)

FOREIGN PATENT DOCUMENTS

GB 2474752 A 10/2010

OTHER PUBLICATIONS

"Wood Magazine—Sanding-Disc Organizer", Wood Magazine, available Aug. 27, 2013, accessed Mar. 28, 2016, http://my.woodmagazine.com/woodworking-plans/sanding/sanding-disc-organizer.*

(Continued)

*Primary Examiner* — Christopher Besler
*Assistant Examiner* — Matthew P Travers
(74) *Attorney, Agent, or Firm* — Armstrong Teasdale LLP

(57) ABSTRACT

A hand sander and sanding disc fixture for attaching a sanding disc to a hand sander includes a table having a top with a sander storage station and an application station thereon. The storage station has a holder capable of holding a hand sander having a sander pad on the top of the table. The application station has at least two datum pegs extending from the top of the table that are capable of passing through two corresponding datum holes in the sanding disc. The at least two datum pegs having datum surfaces configured to be received in datum notches in an outer diameter of the sander pad. The datum pegs are capable of aligning the sander pad with the sanding disc when the sander pad is pressed against an attaching side of the sanding disc.

17 Claims, 7 Drawing Sheets

(51) Int. Cl.

| | |
|---|---|
| ***B25H 3/00*** | (2006.01) |
| ***B25H 1/02*** | (2006.01) |
| ***B24D 9/08*** | (2006.01) |
| ***B25H 1/12*** | (2006.01) |
| ***B25H 1/18*** | (2006.01) |
| ***B25H 1/10*** | (2006.01) |

(52) U.S. Cl.
CPC ..... *B25H 3/006* (2013.01); *B25H 1/10* (2013.01); *B25H 1/12* (2013.01); *B25H 1/18* (2013.01); *Y10T 29/49901* (2015.01); *Y10T 29/49998* (2015.01); *Y10T 29/53961* (2015.01); *Y10T 29/53978* (2015.01)

(58) Field of Classification Search
CPC ..... B25H 1/00; B25H 1/02–1/04; B25H 1/10; B25H 1/12; B25H 1/18; B25H 3/006; B23Q 3/02–3/04; B23Q 3/103; B23Q 3/186; B23P 11/00; B23P 19/04; B23P 19/10; B23P 19/12; B25B 11/00; B25B 11/02; Y10T 29/49895–29/49901; Y10T 29/49998; Y10T 29/53961; Y10T 29/53978
USPC ..... 269/900, 291; 451/5, 359
See application file for complete search history.

(56) References Cited

U.S. PATENT DOCUMENTS

| | | | | |
|---|---|---|---|---|
| 5,231,803 | A * | 8/1993 | Lanzer | B24B 23/03 451/28 |
| 5,377,455 | A | 1/1995 | Lanzer | |
| 6,050,887 | A | 4/2000 | Chang | |
| 6,193,337 | B1 | 2/2001 | Roeker et al. | |
| 6,264,534 | B1 | 7/2001 | Panyard et al. | |
| 6,506,277 | B2 | 1/2003 | Roeker et al. | |
| 6,520,895 | B2 | 2/2003 | Senga et al. | |
| 6,663,478 | B1 | 12/2003 | Ulrich | |
| 7,144,313 | B1 | 12/2006 | Greenwood | |
| 7,771,253 | B2 | 8/2010 | Wuensch | |
| 8,517,799 | B2 | 8/2013 | Panergo et al. | |
| 8,636,562 | B2 | 1/2014 | Marton | |
| 2003/0186635 | A1 * | 10/2003 | Meister | B24B 23/03 451/344 |
| 2004/0053569 | A1 * | 3/2004 | Mueller | B24D 13/147 451/359 |
| 2007/0232211 | A1 * | 10/2007 | Chen | B24B 23/04 451/442 |
| 2011/0023286 | A1 | 2/2011 | Bierman | |
| 2013/0324018 | A1 * | 12/2013 | Shen | B24D 9/085 451/458 |
| 2014/0162535 | A1 * | 6/2014 | Turner | B24D 9/085 451/56 |
| 2016/0039067 | A1 * | 2/2016 | Bonnet | B24B 23/046 451/67 |

OTHER PUBLICATIONS

"The Rockler Sandpaper Disc Station", Rockler, published Nov. 7, 2006, accessed Mar. 28, 2006, http://www.rockler.com/how-to/the-rockler-sandpaper-disc-station/.*

"The Orbital Sandpaper Caddy With Self-Alignment", -BALES- (user name), published Nov. 8, 2013, accessed Mar. 28, 2016, http://www.instructables.com/id/Orbital-Sandpaper-Caddy-With-Self-Alignment/.*

"Sander Holder—Fine Woodworking Tool Review", Fine Woodworking, published Mar. 1, 2007, accessed Mar. 30, 2016, http://www.finewoodworking.com/tool-guide/product-finder/orbital-station-sander-holder.aspx.*

* cited by examiner

METHOD AND FIXTURE FOR ATTACHING A SANDING DISC TO A HAND SANDER

CROSS REFERENCE TO RELATED APPLICATIONS

This application claims the benefit of U.S. Provisional Application No. 61/846,758 filed Jul. 16, 2013 titled APPARATUS AND METHOD FOR ATTACHING AND DETACHING A SANDING DISC FROM A VACUUM-OPERATED ROTARY SANDER, the subject matter of which is herein incorporated by reference in its entirety.

BACKGROUND

The present disclosure relates generally to apparatus and methods for attaching to and detaching a sanding disc from a hand sander.

It is conventional to attach removable sanding discs to rotary and orbital motion sanders. The sanding discs are typically coated on one side with a sandpaper-like texture. These discs are available from many venders. The abrasive disc is typically held on a sander pad that is mounted on the hand sander, such as with a hook-and-loop fastener system. The discs are designed to be used until the abrasive surface has degraded. The disc is then removed from the sander pad and discarded. A replacement disc can then be placed on the sander pad, and sanding can resume.

At least some known hand sanders are coupled to a vacuum system to remove dust and/or debris generated during a sanding operation. Typically, the sanding disc includes openings defined therein and the sander pad includes corresponding openings through which dust and/or debris are pulled by a vacuum created by the vacuum system.

For hobby users, the removal and replacement of the discs represents an inconvenience. However, in such a case, there is plenty of time to remove the spent disc, replace it with a new disc, and resume sanding. While it is time consuming to do so, the replacement of a few discs in this manner would not greatly increase the time to complete the project.

However, such a system is less advantageous when the hand sander is used in an industrial or assembly line operation where the disc is replaced many times in the course of an hour. The time to remove the disc from the sander pad and line up the vacuum holes in a new disc with the vacuum holes in the sander pad and attach the new disc to the sander pad may be excessive. Accordingly, in some instances, the user may be forced to remove the disc by peeling up an edge with a hand. The user would then reapply a sanding disc by hand by visually lining up the vacuum holes in the disc with the holes in the sander pad to the appropriate position. Such a system does not ensure consistent placement of the disc on the sander pad, which can create inconsistences in the sanding performance.

Accordingly, it is advantageous to create an apparatus and method for removing and applying a sanding disc to a sander pad that minimizes these detrimental results.

BRIEF DESCRIPTION

In one embodiment, a hand sander and sanding disc fixture is provided for attaching a sanding disc to a hand sander. The fixture includes a table having a top, a sander storage station on the table, and an application station on the table. The storage station has a holder capable of holding a hand sander having a sander pad on the top of the table. The application station has at least two datum pegs extending from the top of the table that are capable of passing through two corresponding datum holes in the sanding disc. The at least two datum pegs having datum surfaces configured to be received in datum notches in an outer diameter of the sander pad. The datum pegs are capable of aligning the sander pad with the sanding disc when the sander pad is pressed against an attaching side of the sanding disc.

In another embodiment, a hand sander and sanding disc fixture is provided for attaching a sanding disc to a hand sander. The fixture includes a table have a top. A sander storage station is provided on the table. The sander storage station has a holder holding a hand sander having a sander pad on the top of the table. A sanding disc storage station is provided on the table. The sanding disc storage station has a central spindle extending from the top of the table. The central spindle holds a stack of sanding discs with the central spindle extending through a central hole of each sanding disc. An application station is provided on the table. The application station has at least two datum pegs extending from the top of the table. The datum pegs hold a stack of sanding discs with attaching sides of the sanding discs facing away from the top of the table for attachment to the hand sander. The datum pegs pass through datum holes in the sanding discs to align the sanding discs with the sander pad when the sander pad is pressed against the attaching side of the outermost sanding disc.

In another embodiment, a method of attaching a sanding disc to a hand sander is provided that includes providing at least two datum pegs extending from a top of a table. The method includes positioning a sanding disc with the at least two datum pegs extending through corresponding datum holes in the sanding disc, the sanding disc being positioned with an attaching side of the sanding discs facing away from the top of the table. The method includes aligning a hand sander with the sanding disk by pressing the hand sander against the at least two datum pegs such that corresponding datum notches in an outer diameter of a sander pad of the hand sander each receive a corresponding one of the at least two datum pegs. The method includes sliding the hand sander toward the top of the table along the at least two datum pegs until the sanding pad is pressed against the attaching side of the sanding disc.

In a further embodiment, a sander pad is provided that includes an attachment shaft extending from a first surface of the sander pad for coupling the sander pad to a sanding device. An attachment surface is positioned on a second surface of the sander pad, opposite to the first surface of the sander pad, and configured to removably couple a sanding disc to the sander pad. A plurality of datum notches are formed in a perimeter of the sander pad and configured to facilitate alignment of the sanding disc and the sander pad.

DETAILED DESCRIPTION

Figure 1:
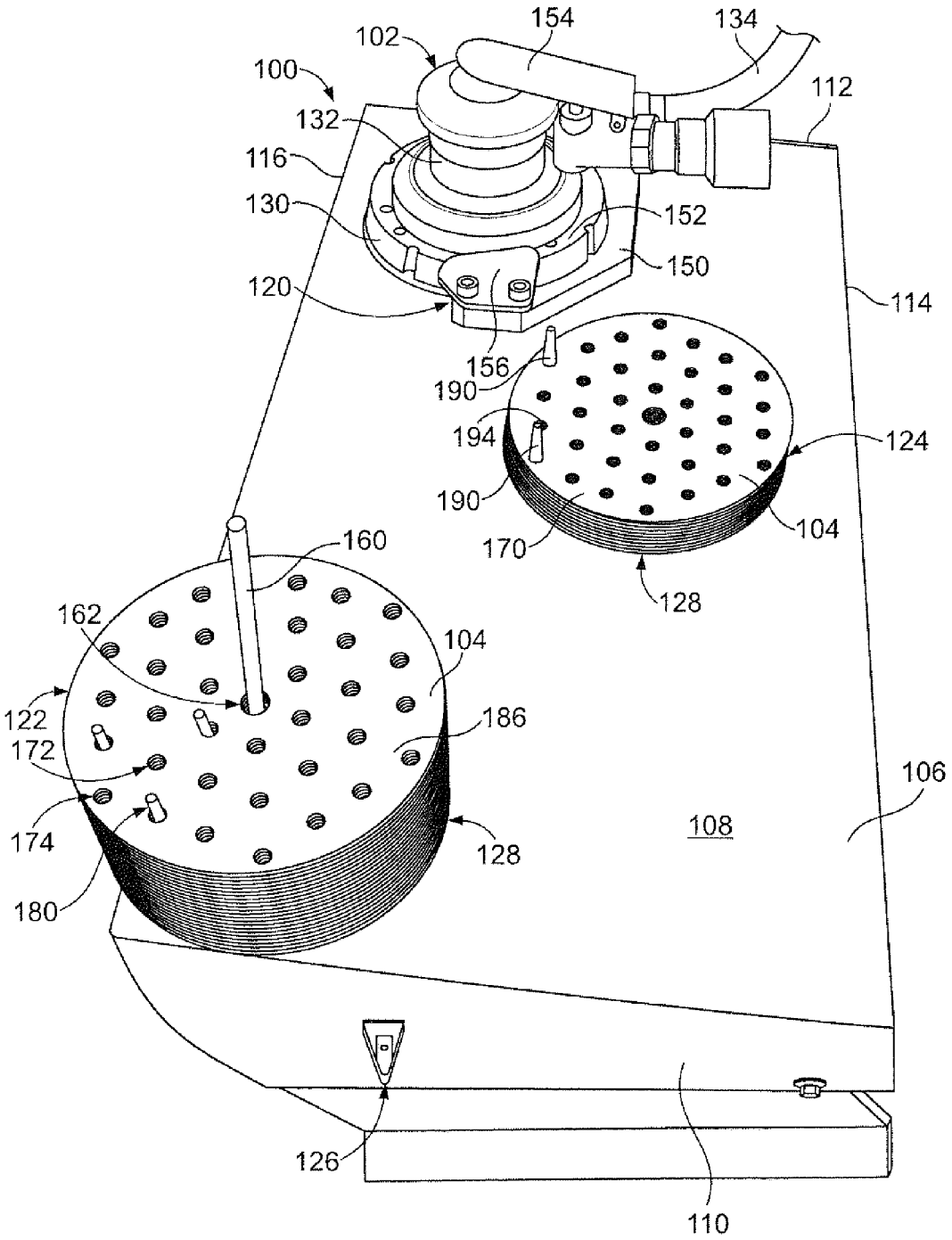
FIG. 1 is a perspective view of a hand sander and sanding disc fixture formed in accordance with an exemplary embodiment.
Figure 2:
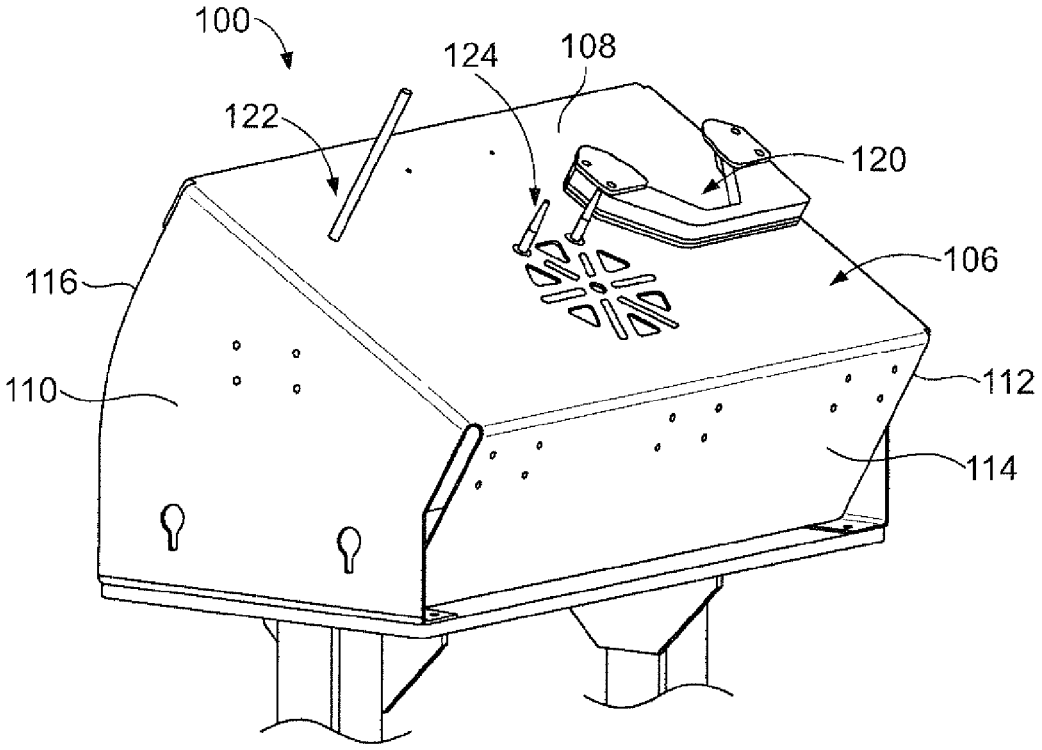
FIG. 2 is a front perspective view of the fixture shown in FIG. 1.
Figure 3:
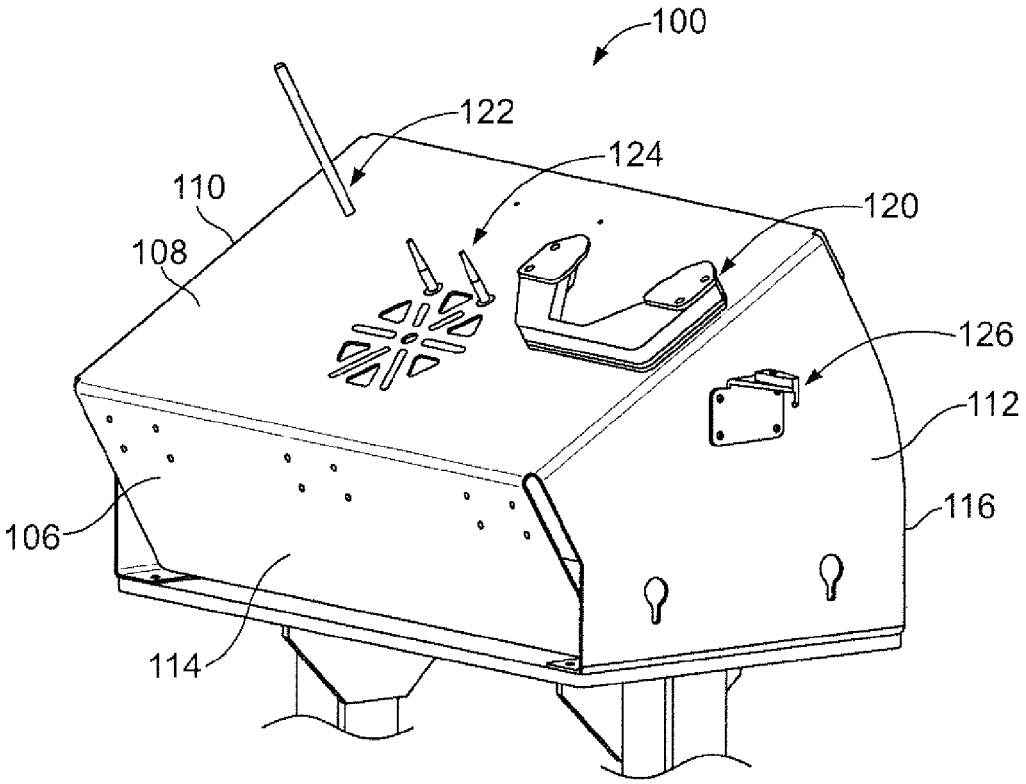
FIG. 3 is another front perspective view of the fixture shown in FIG. 1.
Figure 4:
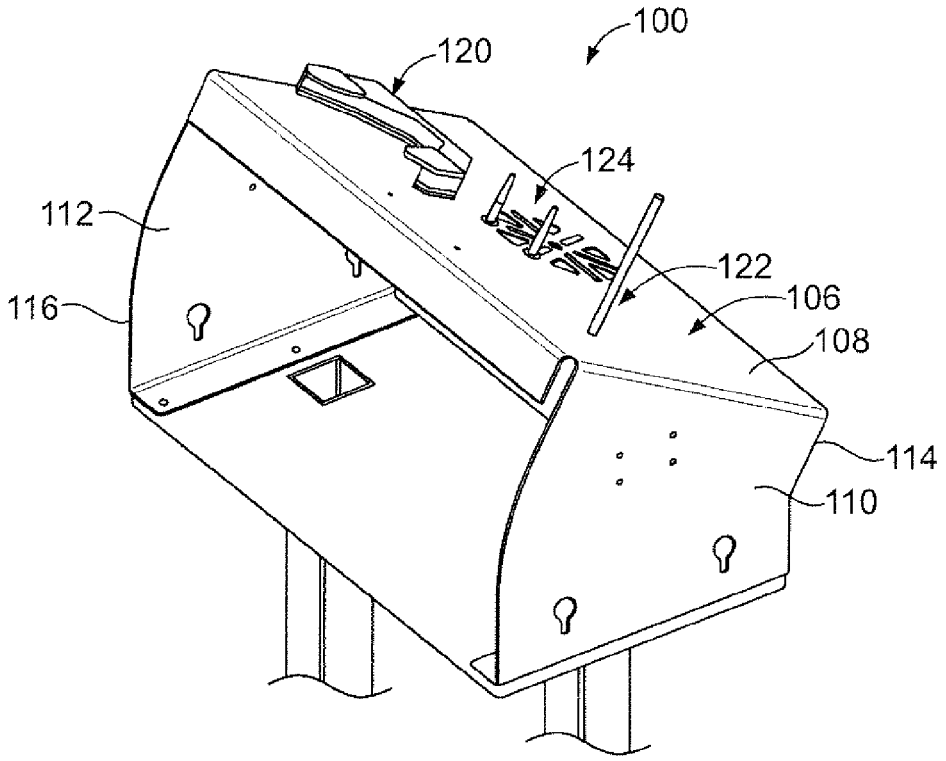
FIG. 4 is a rear perspective view of the fixture shown in FIG. 1.
Figure 5:
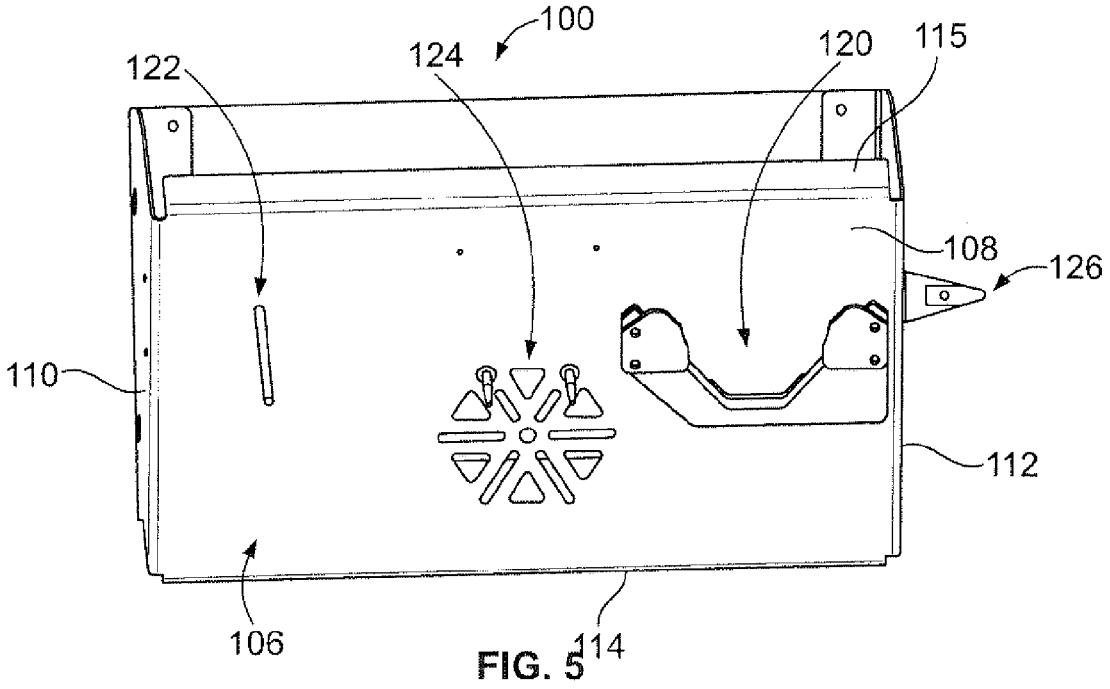
FIG. 5 is a top view of the fixture shown in FIG. 1.

FIG. 1 is a perspective view of a hand sander and sanding disc fixture 100 formed in accordance with an exemplary embodiment. FIG. 2 is a front perspective view of the fixture 100. FIG. 3 is another front perspective view of the fixture 100. FIG. 4 is a rear perspective view of the fixture 100. FIG. 5 is a top view of the fixture 100. The fixture 100 is used to support a hand sander 102 (FIG. 1) and a plurality of sanding discs 104 (FIG. 1) during periods of use and non-use. The fixture 100 is used for attaching and detaching the sanding discs 104 to and from the hand sander 102.

The fixture 100 includes a table 106 having a top 108. The table 106 includes sides 110, 112, a front 114 and a rear 116. Optionally, the table 106 may be angled such that the top 108 is non horizontal. For example, the front 114 may be lower than the rear 116. Optionally, the table 106 may be angled between 30° and 60°. In other alternative embodiments, the table 106 may be oriented horizontally. In other alternative embodiments, the table 106 may be oriented vertically. Optionally, the sides 110, 112, may be adjustable to vary the angle of the table 106. For example, adjustable brackets may be provided on the sides 110, 112 to adjust the angle of the top 108 of the table 106.

In an exemplary embodiment, the fixture 100 includes a plurality of stations that serve different functions. In the illustrated embodiment, the fixture 100 includes a hand sander storage station 120, a sanding disc storage station 122, a sanding disc application station 124, and at least one sanding disc removal station 126. In other embodiments, it may be desirable to use only some of these stations. In other embodiments, other stations may be added as desired. The stations may be oriented to conveniently access the hand sander 102 and/or the sanding discs 104.

The hand sander 102 is stored in the storage station 120 when the hand sander 102 is not in use. A plurality of the sanding discs 104 is stored in the sanding disc storage station 122 for easy access when additional sanding discs 104 are needed. Optionally, the sanding discs 104 may be stored in groups or stacks 128 of sanding discs 104. Each stack 128 of sanding discs 104 may include any number of sanding discs 104, such as approximately 25 sanding discs. These stacks 128 of sanding discs 104 may be placed in the sanding disc storage station 122 as a group and/or may be removed from the sanding disc storage station 122 as a group, such as to move one stack of the sanding discs 104 at a time from the sanding disc storage station 122 to the sanding disc application station 124. The sanding discs 104 at the application station 124 are ready for attachment to the hand sander 102 when the sanding disc 104 on the hand sander 102 needs to be replaced. The sanding disc 104 on the hand sander 102 may be removed at the removal station 126. The removal station 126 may be provided at any location, such as along at least one of the sides 110 and/or 112, along the front 114 or at another location. After removal, the outermost sanding disc 104 at the application station 124 may be easily and conveniently applied to the hand sander 102.

The hand sander 102 includes a sander pad 130 coupled to a sanding device 132 that causes the sander pad 130 to rotate during a sanding operation. In an exemplary embodiment, the sanding device 132 is pneumatically operated. Alternatively, the sanding device 132 may be electrically operated. In an exemplary embodiment, a vacuum system 134 is coupled to the sanding device 132 to remove dust and debris during the sanding operation. The vacuum system 134 creates a vacuum through holes in the sander pad 130 and holes in the sanding disc 104 to remove dust and debris during the sanding operation.

Figure 6:
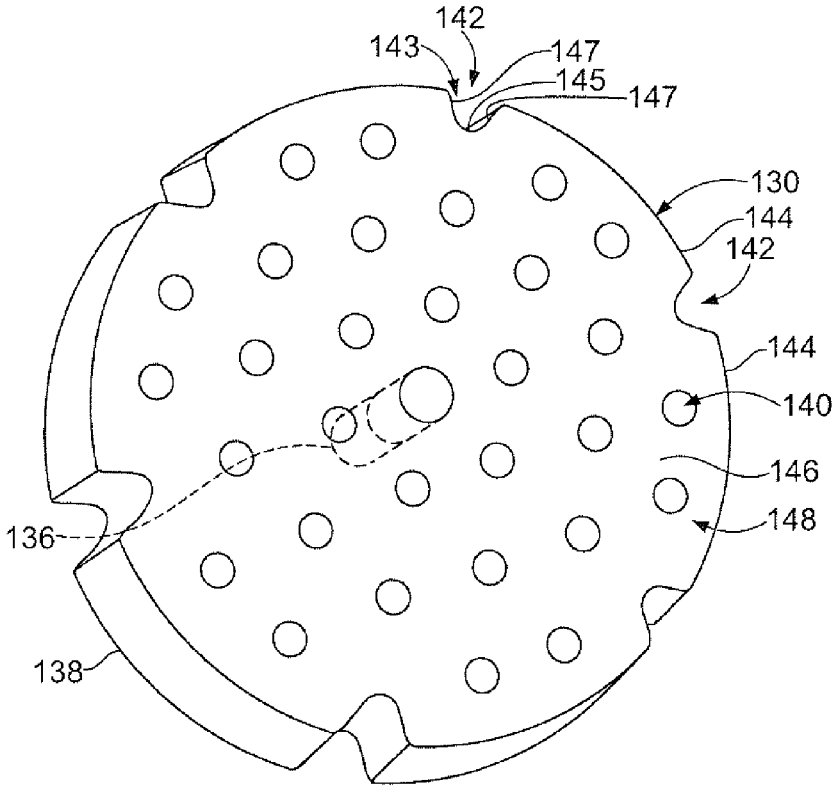
FIG. 6 is a bottom perspective view of a sander pad of the hand sander shown in FIG. 1 that is formed in accordance with an exemplary embodiment.

FIG. 6 is a bottom perspective view of the sander pad 130 in accordance with an exemplary embodiment. The sander pad 130 includes an attachment shaft 136 extending from a top or first side 138 of the sander pad 130. The attachment shaft 136 is used to attach the sander pad 130 to the sanding device 132 (shown in FIG. 1). Optionally, the attachment shaft 136 may be threaded. The attachment shaft 136 may have external threads or internal threads, such as in a threaded bore, which are used to secure the sander pad 130 to the sanding device 132. Other types of attachment components may be used in alternative embodiments.

The sander pad 130 includes a plurality of vacuum holes 140 in spaced relation to one another. The precise shape, size, and configuration of the vacuum holes 140 are not critical to the present disclosure. A sander pad 130 having a different number, size, and shape of vacuum holes 140 could be used instead of the embodiment shown. In some alternative embodiments, the sander pad 130 may not include any holes of any kind. The size, shape, and position of the vacuum holes 140 may be related to the vacuum system 134 (shown in FIG. 1) to allow a vacuum to be created through the sander pad 130.

The sander pad 130 includes a plurality of datum notches 142 having open sides 143 formed in a perimeter or outer diameter 144 of the sander pad 130. The notches 142 are open along the outer diameter 144. In the illustrated embodiment, the notches 142 are V-shaped; however the notches 142 may have other shapes, sizes, and positions in alternative embodiments. The notches 142 have a seat 145 opposite the open side 143 thereof with side walls 147 extending between the seat 145 and the open side 143. Optionally, the side walls 147 may be non-parallel with respect to each other. The notches 142 are used to align or register the sander pad 130 with the sanding discs 104 (shown in FIG. 1) at the application station 124 (shown in FIG. 1), as described in further detail below.

In an exemplary embodiment, the sander pad 130 includes at least two notches 142. Optionally, the notches 142 may be positioned equally around the outer diameter 144. The use of equally spaced notches 142 allows a user to more easily index the sander pad 130 with the sanding discs 104 at the application station 124. For example, because the sander pad 130 is configured to orbit and/or rotate, the sander pad 130 may be permitted to stop in any position after the removal of the rotary force. The use of multiple notches 142 would allow alignment of the sander pad 130 at any pad position.

In some embodiments, it may be desirable to just use a single notch or a specified number of notches instead. In such embodiments, it may also be desirable to incorporate a stop on the sander pad 130 to ensure a similar placement of the pad each time the rotary force is removed. This may minimize the need for the user to look for the position of the notch 142 and possibly be forced to rotate his or her hand and arm in a complicated manner to secure the next sanding disc 104 to the sander pad 130.

The sander pad 130 includes an attachment surface 146 at a bottom 148 of the sander pad 130. The attachment surface 146 is used to attach the sanding disc 104 to the sander pad 130. Optionally, the attachment surface 146 may include a hook structure or a loop structure for hook-and-loop attachment of the sanding disc 104 to the sander pad 130. Other types of attachment devices may be used in alternative embodiments.

Returning to FIG. 1, the hand sander storage station 120 includes a holder 150 used to hold the hand sander 102. The holder 150 includes a lip 152 that engages and supports the sander pad 130 and/or the sanding device 132. Optionally, the lip 152 may be semi-circular in shape to allow the hand sander 102 to be placed in the holder 150 from above the holder 150. The hand sander 102 may hang from the holder 150. The lip 152 may stop the hand sander 102 from tipping to one side or the other. For example, the lip 152 may extend behind the sander pad 130. Optionally, the holder 150 may define a shelf for the hand sander 102 to rest on when not in use with one or more tabs 156 extending from the holder 150 behind the sander pad 130. The tabs 156 hold the hand sander 102 in the holder 150. The hand sander 102 may be removed by moving the hand sander 102 toward that rear 116 of the table 106 until the hand sander 102 is removed from the holder 150.

The holder 150 minimizes the risk of the hand sander 102 from rolling over and activating a hand sander throttle lever 154 on a top of the sanding device 132. If the hand sander 102 would roll over and the sanding device 132 turn on, it would be necessary for the operator to grab the hand sander 102 while it is running and risk injury from the sanding disc 104. In an exemplary embodiment, the shape of the holder 150 corresponds in shape and size to the shape and size of the sander pad 130. However, in other embodiments, such a correspondence may be unnecessary. Optionally, the size and shape of the holder 150 may be adjustable to accommodate different sized and shaped hand sanders 102. The holder 150 may be removable from the table 106, such as by removable fasteners. The holder 150 may be sized to accommodate any sanding disk 104 on the sander pad 130, such as by having an undercut or opening that receives the sanding disk 104 so as to not bend or deform any portion of the sanding disk 104 that extends beyond the edge or outer perimeter of the sander pad 130.

The sanding disc storage station 122 is provided at another location on the table 106. The sanding disc storage station 122 includes a central spindle 160 extending from the top 108 of the table 106. The central spindle 160 passes through a central hole 162 in each of the sanding discs 104 stored in the sanding disc storing station 122. The central spindle 160 is an elongated post long enough to hold multiple stacks 128 of sanding discs 104.

Figure 7:
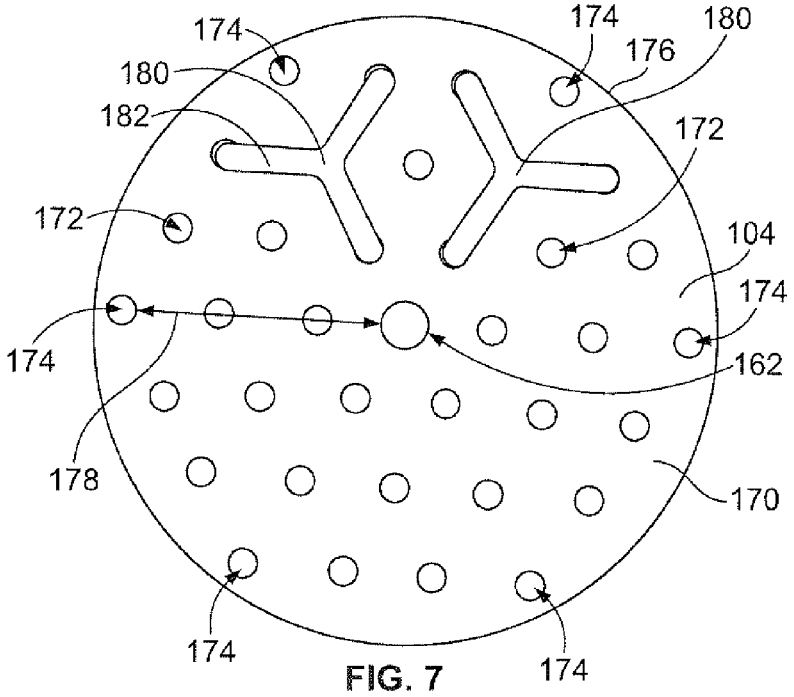
FIG. 7 is a bottom view of a sanding disc shown in FIG. 1 that is formed in accordance with an exemplary embodiment.

FIG. 7 is a bottom view of one of the sanding discs 104 formed in accordance with an exemplary embodiment. FIG. 7 illustrates an attaching side 170 of the sanding disc 104. The attaching side 170 is configured to be attached to the sander pad 130 (shown in FIG. 6). Optionally, the attaching side 170 may include a hook structure or a loop structure for hook-and-loop attachment to the sander pad 130. Other types of attaching structures may be used in alternative embodiments to attach the sanding disc 104 to the sander pad 130. The sanding disc 104 includes an abrasive side (not shown) opposite the attaching side 170. The abrasive side is used for the sanding operation.

The sanding disc 104 includes a plurality of holes. The holes may serve different functions. In an exemplary embodiment, the sanding disc 104 is circular and the central hole 162 is located at a center of the circular sanding disc 104. The sanding disc 104 may have other shapes in alternative embodiments.

In an exemplary embodiment, the sanding disc 104 includes a plurality of vacuum holes 172. The vacuum holes 172 are configured to be aligned with the vacuum holes 140 (shown in FIG. 6) in the sander pad 130. The vacuum from the vacuum system passes through the vacuum holes 172. The precise shape, size, and configuration of the vacuum holes 172 are not critical to the present disclosure. The sanding disc 104 may have a different number, size, and shape of vacuum holes 172 that correspond to the vacuum holes 140 in the sander pad 130.

In an exemplary embodiment, the sanding disc 104 includes a plurality of datum holes 174 in spaced relation to one another. The datum holes 174 are used to locate the sanding disc 104 in the application station 124 (shown in FIG. 1) and are used to locate the sanding disc 104 relative to the sander pad 130. In an exemplary embodiment, the datum holes 174 are positioned near an outer edge 176 of the sanding disc 104. The datum holes 174 are closed such that a portion of the sanding disc 104 is positioned between the datum holes 174 and the outer edge 176. The datum holes 174 have a spacing that corresponds to a spacing of the notches 142 (shown in FIG. 6) of the sander pad 130. Optionally, the datum holes 174 may have a shape and size that is similar or equal to the shape and size of the vacuum holes 172. Alternatively, the datum holes 174 may be sized and/or shaped differently than the vacuum holes 172. The datum holes 174 may be positioned a distance 178 from the central hole 162. The distance 178 may be greater than the distance of any of the vacuum holes 172 to the central hole 162. As such, the datum holes 174 are positioned further from the central hole 162 than the vacuum holes 172. In some embodiments, at least some of the datum holes 174 may define vacuum holes with the vacuum from the vacuum system passing there through.

Stack holders 180 are shown in FIG. 7 in functional relationship to the sanding disc 104. The stack holders 180 pass through the vacuum holes 172 and are used to stack multiple sanding discs 104 together in one of these stacks 128 (Shown in FIG. 1). In an exemplary embodiment, only a single stack holder 180 is used for stacking the sanding discs 104, however multiple stack holders 180 may be used. The stack holders 180 are sized and shaped to correspond to the vacuum holes 172 to pass through multiple vacuum holes 172 and orient the sanding discs 104 relative to each other. The stack holder 180 includes a base 182. The stack holder 180 includes legs 184 (shown in FIG. 8) extending from the base 182. The legs 184 are the portions of the stack holder 180 that extend through the vacuum holes 172. The base 182 may include individual beams meeting at a hub and extending to the legs 184, as in the illustrated embodiment. Other embodiments may include a disc-shaped base with the legs 184 extending therefrom.

Figure 8:
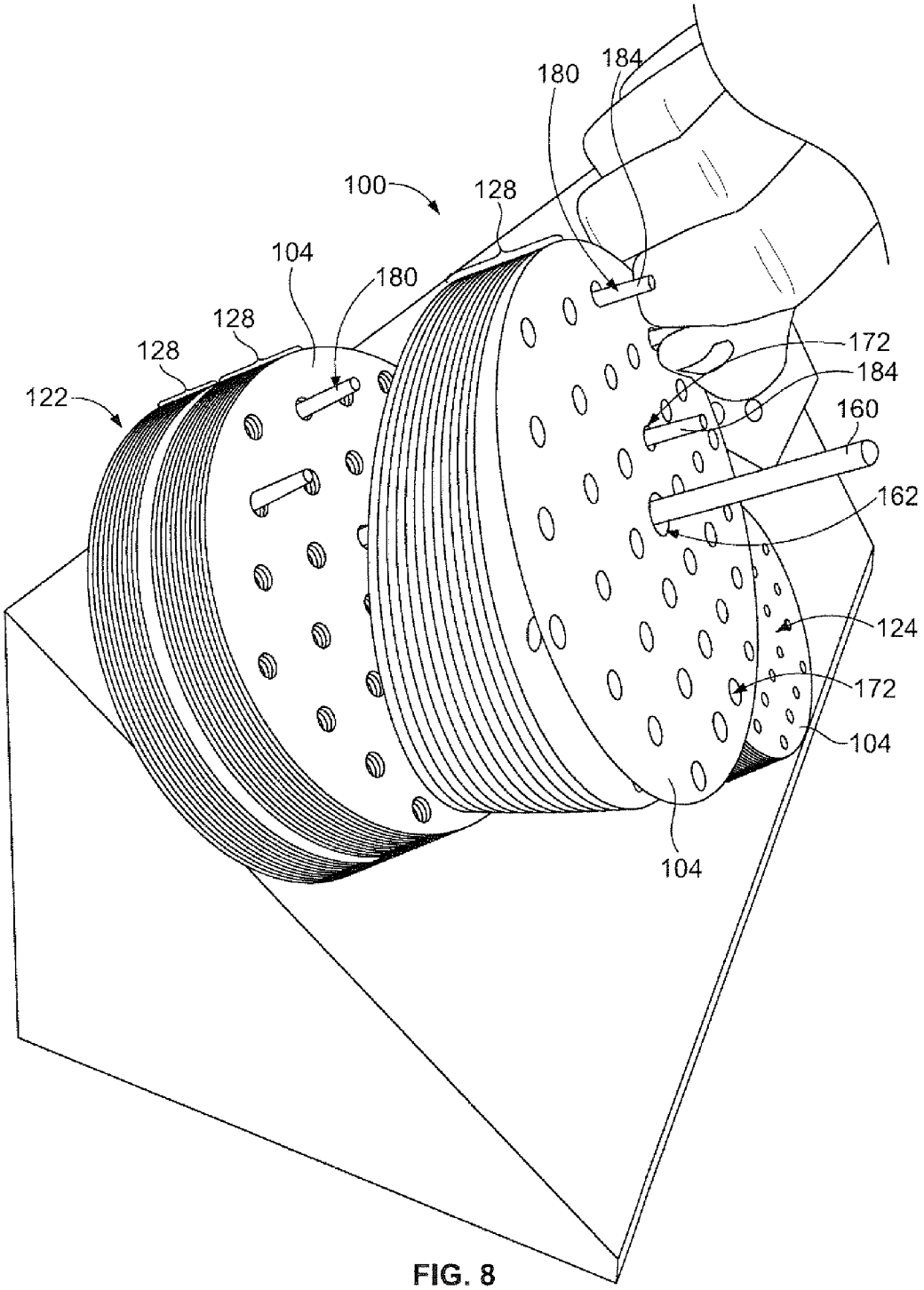
FIG. 8 is a top perspective view of a portion of the fixture of FIG. 1 showing a sanding disc storage station.

FIG. 8 is a top perspective view of a portion of the fixture 100 showing the sanding disc storage station 122 with a plurality of stacks 128 of sanding discs 104 stored in the sanding disc storage station 122. The central spindle 160 passes through the center holes 162 of each of the sanding discs 104 in the storage station 122. The stack holders 180 are used to hold a plurality of the sanding discs 104 together in each stack 128. The legs 184 of the stack holders 180 pass through the holes 172, which orients the sanding discs 104 relative to each other such that the holes 172 of each sanding disc 104 are aligned. Optionally, the legs 184 may be able to pass through the datum holes 174 in addition to the holes 172; however in other embodiments the datum holes 174 may be spaced to restrict accepting the legs 184 so there is no interference with the datum holes 174 when loading the stack 128 in the application station 124 (such as onto datum pegs in the application station 124). The legs 184 minimize relative rotation between the sanding discs 104.

In an exemplary embodiment, the legs 184 extend beyond the outer most sanding disc 104 and protrude any desired distance over the outer most sanding disc 104 to allow a user to easily grasp the stack holder 180. The user may grasp the stack holder 180 and pull the stack 128 off of the central spindle 160. The user may then move the stack 128 to another station, such as the application station 124 (shown in FIG. 1). The stack holder 180 may be discarded and recycled after the stack 128 is moved to the application station 124. Optionally, the legs 184 may protrude a sufficient distance to allow the user to grasp the legs 184 even when the user is wearing gloves.

In an exemplary embodiment, the stack holders 180 may fit a plurality of locations on a given sanding disc 104. Because the legs 184 extend beyond the outer most sanding disc 104, when a stack 128 of sanding discs 104 is placed on top of another stack 128 of sanding discs 104, the free ends of the legs 184 of the stack holder 180 in the lower or bottom stack 128 may be allowed to protrude through the next higher or top stack of sanding discs 104 until that top stack 128 of sanding discs 104 is removed, thereby exposing the free ends of the legs 184 of the next lower stack holder 180. The stacks 128 are positioned in the storage station 122 such that the stack holders 180 are offset with respect to each other. For example, the stack holder 180 of the top stack 128 may be positioned slightly clockwise of the stack holder 180 of the bottom stack 128 such that the stack holders 180 do not interfere with each other. In other words, adjacent stacks 128 of the sanding discs 104 have the stack holders 180 positioned differently, such as in a spiral manner. The stack holders 180 may be positioned at any location that does not interfere with the stack holder 180 of the lower stacks 128. FIG. 8 illustrates three stacks 128 of sanding discs 104 in the storage station 122 on the central spindle 160, however more or less stacks 128 may be provided in the storage station 122.

Returning to FIG. 1, one of the stacks 128 of sanding discs 104 are shown in the sanding disc application station 124. In the application station 124, the sanding discs 104 are stored with the attaching side 170 facing upwards and the abrasive side facing downward. In an exemplary embodiment, the sanding discs 104 are stored in the sanding disc storage station 122 with an abrasive side 186 facing upward. The user may grasp the stack holder 180 and remove the stack 128 of sanding discs 104 from the storage station 122 and may then invert the stack 128 into the application station 124, where the stack holder 180, which is then on top of the stack 128, may be removed and discarded. The stack holder 180 is used to align the holes in the sanding discs 104, such as the datum holes 174, for ease of loading the stacks 128 into the application station 124. The sanding discs 104 are stored in the application station 124 with the attaching side 170 facing upward for attachment to the hand sander 102.

In other embodiments, the use of stack holders 180 may not be necessary, and the sanding discs 104 can be stored with the attaching side 170 facing upward in the storage station 120 such that the sanding discs 104 may be simply picked up from the storage station 122 and moved to the application station 124 without flipping the sanding discs over. In other alternative embodiments, the sanding disc storage station 122 and the application station 124 may be combined into a single station. For example, the storage station 122 may be unnecessary and the sanding discs 104 may be stored at the application station 124.

The application station 124 includes a plurality of datum pegs 190 extending from the top 108 of the table 106. The datum pegs 190 hold a stack 128 of the sanding discs 104 with the attaching sides 170 of the sanding discs 104 facing away from the top 108 of the table 106. The datum pegs 190 pass through the datum holes 174 in the sanding discs 104. When the sanding discs 104 are placed on the datum pegs 190 the sanding discs 104 are aligned and the vacuum holes 172 are aligned and positioned for attachment to the hand sander 102. The datum pegs 190 maintain alignment of the vacuum holes 172 in the sanding discs 104 included in the stack 128 of sanding discs 104. In an exemplary embodiment, the fixture 100 includes at least two datum pegs 190.

The datum pegs 190 have an outer surface defining a datum surface. The datum pegs 190 extend to tips 194. The tips 194 are exposed beyond the outer most sanding disc 104. The datum pegs 190 hold the positions of the sanding discs 104 relative to the table 106. Optionally, the datum pegs 190 may be tapered such that the datum pegs 190 are thinner at the tips 194 and ticker at the base of the datum pegs 190. Having the datum pegs 190 tapered makes loading of the sanding discs 104 onto the datum pegs 190 easier. The datum pegs 190 are used to align the hand sander 102 with the outer most sanding disc 104 for easy application of the sanding disc 104 to the sander pad 130.

Figure 9:
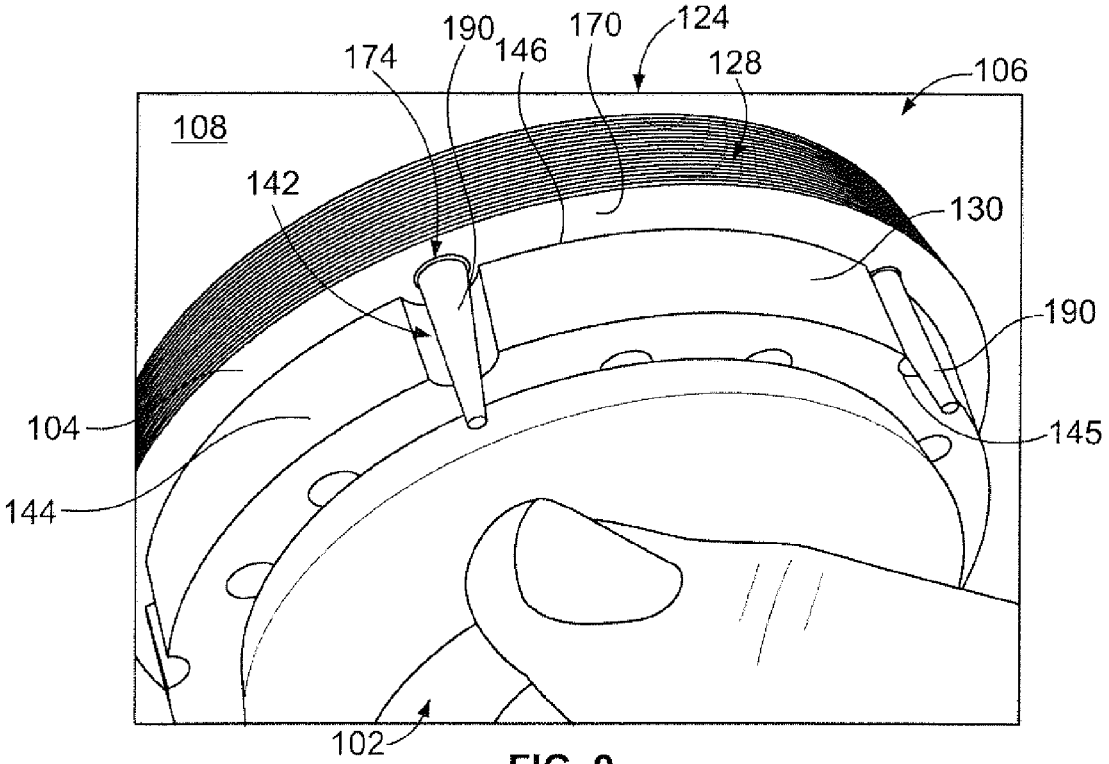
FIG. 9 is a top respective view of a portion of the fixture of FIG. 1 showing the hand sander attached to the sanding disc in an application station.
Figure 10:
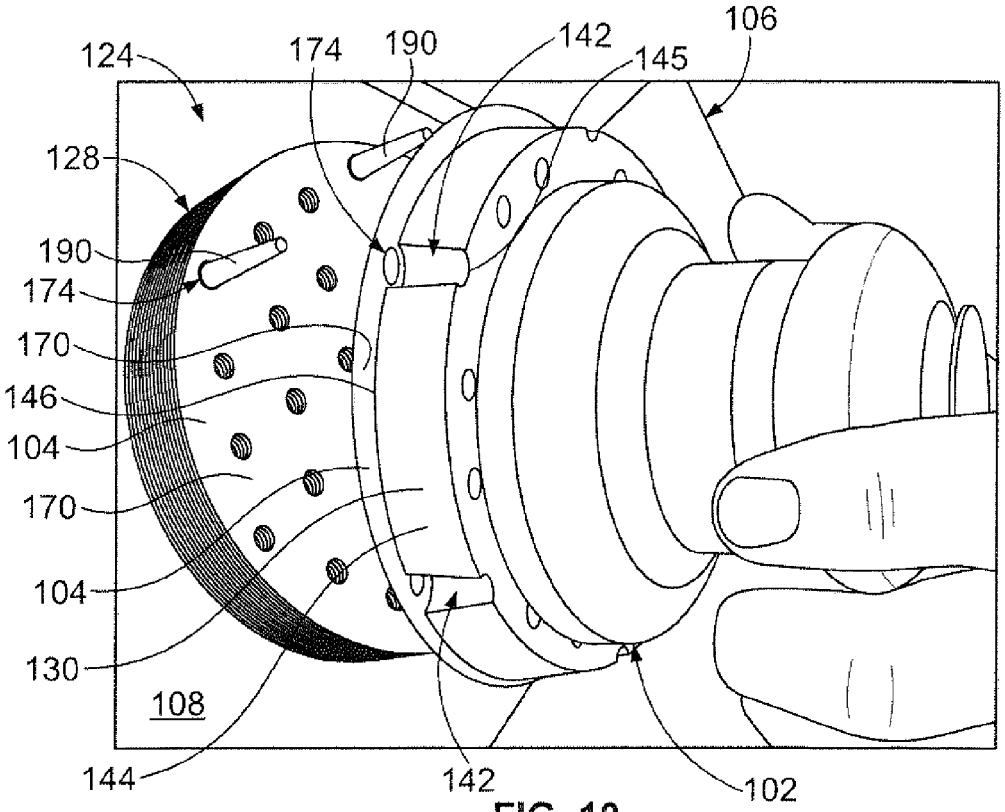
FIG. 10 illustrates one of the sanding discs being removed with the hand sander from the application station shown in FIG. 9.

FIG. 9 is a top perspective view of a portion of the fixture 100 showing the hand sander 102 attached to the outermost sanding disc 104 in the application station 124. FIG. 10 illustrates one of the sanding discs 104 being removed with the hand sander 102 from the application station 124. The datum pegs 190 are used to index the sander pad 130 with the sanding disc 104. During the attaching process, the sander pad 130 is placed against the datum pegs 190 such that the datum pegs 190 are received in corresponding notches 142 in the sander pad 130. The sander pad 130 is then pressed toward the sanding discs 104 with the datum pegs 190 maintaining alignment of the sander pad 130 with the sanding discs 104. When the attachment surface 146 of the sander pad 130 contacts the attaching side 170 of the sanding disc 104 the sanding disc 104 is attached to the sander pad 130 and the sanding disc 104 may be removed from the stack 128 by moving the hand sander 102 away from the table 106. The user may then use the hand sander 102 and sanding disc 104 as desired. The sanding disc 104 may be attached by a hook-and-loop structure on the attaching side 170 and the attachment surface 146.

In the illustrated embodiment, two datum pegs 190 are used to index the position of the sander pad 130 and the sanding disc 104. In other embodiments, a different number of datum pegs 190 may be used. Also, in the embodiment shown, the datum pegs 190 have a circular cross section. In other embodiments, datum pegs of a different shape may be used. A person having ordinary skill in the art may select an appropriate corresponding datum peg and datum notch configuration to achieve the particular desired outcome.

The datum pegs 190 are used to support the sanding discs 104. Optionally, the sanding discs 104 may hang from the datum pegs 190. For example, the datum pegs 190 pass through the sanding discs 104, such as through the datum holes 174. The sander pad 130 includes the open-sided notches 142, and the sander pad 130 may be side-loaded into position against the datum pegs 190 with the datum pegs 190 being pressed against the seats 145 of the notches 142. For example, because the notches 142 are open along the outer diameter 144 of the sander pad 130, the sander pad 130 may be brought into position in the application station 124 from the side (e.g., generally parallel to the top 108 of the table 106) as opposed to needing to be loaded from the top downward toward the table 106. The seats 145 may have complementary shapes to the datum pegs 190. The open sided notches 142 make it easier for positioning the hand sander 102 in the application station 124, such as compared to having closed holes in the sander pad 130 that need to be aligned with the datum pegs 190 and loaded in a direction perpendicular to the top 108 of the table 106. The datum notches 142 are disposed equidistant from each adjacent datum notch 142 such that any of the datum notches 142 may received the corresponding datum pegs 190. The vacuum holes 140 are positioned relative to the datum notches 142 such that each of the vacuum holes 140 are configured to be aligned with vacuum holes 172 in the sanding disk 104 irrespective of which datum notches 142 receive the datum pegs 190. The sander pad 130 may be loaded into position against the datum pegs 190 by side-loading in a direction non-parallel to the datum pegs 190, such as in a perpendicular direction or a transverse direction. In this manner, the datum notches may be configured to facilitate alignment of the sanding disc 104 and the sander pad 130.

Optionally, the datum pegs 190 may be removable from the table 106 and adjustable to different relative positions to accept sanding discs 104 having different configurations of datum holes 174. For example, the datum pegs 190 may be threadably coupled to the table 106 and the table 106 may include multiple threaded bores that the datum pegs 190 may be threaded into. The datum pegs 190 may be moved relative to each other and relative to the table 106. For example, a user may be able to configure the datum pegs 190 in the application station 124 to accommodate a variety of sanding discs and corresponding sanding pads 130. Such a feature may be more desirable in a hobby-type environment, or a single user may use a variety of sanding discs 104 and a variety of sanding pads 130. In an industrial setting, where only a single sander pad 130 and corresponding sanding discs 104 may be used, the datum pegs 190 may be welded or otherwise fixed in place to enhance durability, if desired.

Returning to FIG. 1, when the sanding disc 104 has reached the end of its useful life, the fixture 100 may be used to efficiently remove the sanding disc 104 from the sander pad 130. For example, the sanding disc 104 may be removed at the sanding disc removal station 126. After removal of the sanding disc 104 the hand sander 102 may be moved to the application station 124 to attach a new sanding disc 104 to the hand sander 102.

Figure 11:
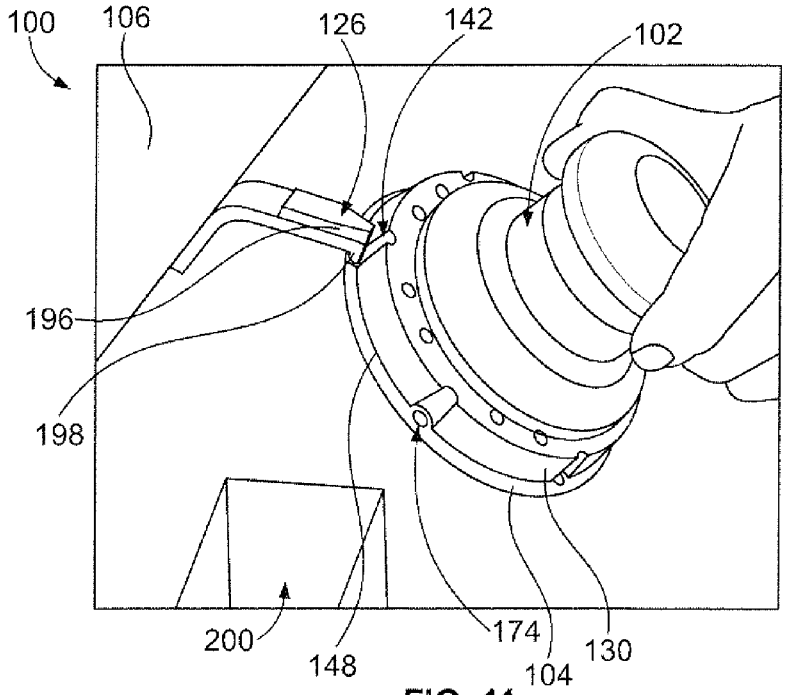
FIG. 11 illustrates the hand sander in a sanding disc removal station of the fixture shown in FIG. 1.
Figure 12:
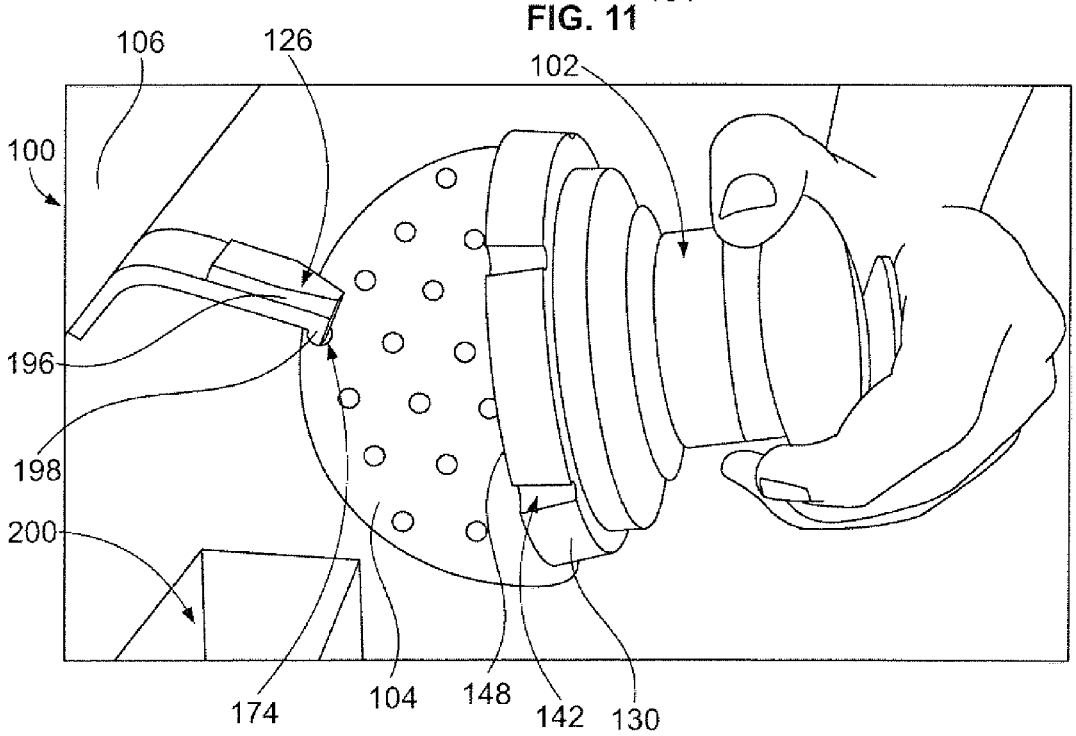
FIG. 12 illustrates one of the sanding discs being removed from the hand sander at the sanding disk removal station shown in FIG. 11.

FIG. 11 illustrates the hand sander 102 in the sanding disc removal station 126. FIG. 12 illustrates one of the sanding discs 104 being removed from the hand sander 102.

The fixture 100 includes a removal tool 196 extending from the table 106. The removal tool 196 has a hook 198 at an end of the removal tool 196. The notches 142 in the sander pad 130 expose a portion of the sanding disc 104, which may be engaged by the removal tool 196 to remove the sanding disc 104 from the hand sander 102. For example, the datum holes 174 and corresponding portions of the sanding disc 104 surrounding the datum holes 174 are exposed below the notches 142. Optionally, the sanding disc 104 may be larger than the bottom 148 of the sander pad 130 to provide a surface for gripping and removing the sanding disc 104 from the hand sander 102. During removal, the hook 198 is placed adjacent any desired notch 142 and through a corresponding datum hole 174 in the sanding disc 104. The hand sander 102 is moved upwardly. The hook 198 removes the sanding disc 104 from the sander pad 130 without contact by a user's hands. Pulling upward on the hand sander 102 separates the sanding disc 104 from the sander pad 130.

In an exemplary embodiment, the fixture 100 may include a disposal station 200 adjacent the removal station 126. The disposal station 200 catches the spent sanding discs 104 to be later discarded. For example, the disposal station 200 may include a trash receptacle or other device used to discard the used sanding discs 104. Once the sanding disc 104 has been removed, the user may then align the notches 142 with the datum pegs 190 (shown in FIG. 1) to install a new sanding disc 104 and resume standing.

The notches 142 on the sander pad 130 and the corresponding datum holes 174 on the sanding disc 104 may serve the purposes of improving the attachment of the sanding disc 104 to the sander pad 130, removal of the sanding disc 104 from the sander pad 130, and/or aligning the sanding disc to the sander pad 130 for full flow of the vacuum through the sanding disc 104 and the sander pad 130, while minimizing the time spent by the user in achieving these tasks and minimizing the risk of injury to the user.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from their scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, paragraph (f), unless and until such claim limitations expressly use the phrase "means for" followed by a statement of function void of further structure.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

The foregoing description of embodiments and examples has been presented for purposes of illustration and description. It is not intended to be exhaustive or limiting to the forms described. Numerous modifications are possible in light of the above teachings. Some of those modifications have been discussed and other will be understood by those skilled in the art. The embodiments were chosen and described for illustration of various embodiments. The scope is or course, not limited to the examples or embodiments set forth herein, but can be employed in any number of applications and equivalent devices by those of ordinary skill in the art. Rather it is hereby intended the scope be defined by the claims appended hereto. Additionally, the features of various implementing embodiments may be combined to form further embodiments.

What is claimed is:

1. A system comprising:

a hand sander including a sander pad having at least two datum notches defined in an outer perimeter of the sander pad; and a sanding disc fixture for attaching a sanding disc to the hand sander, the sanding disc fixture comprising:

a table having a top; and an application station on the table, the application station having at least two datum pegs extending from the top of the table, the datum pegs capable of passing through two corresponding datum holes in the sanding disc, the at least two datum pegs having datum surfaces configured to be received in the datum notches in the outer perimeter of the sander pad of the hand sander, the datum pegs capable of aligning the sander pad with the sanding disc when the sander pad is pressed against an attaching side of the sanding disc, wherein the at least two datum pegs are oriented to receive the sander pad via side loading such that the datum surfaces are received in the datum notches.

2. The system of claim 1, wherein the sanding discs have vacuum holes capable of being aligned with vacuum holes in the sander pad by the datum pegs.

3. The system of claim 2, wherein the datum pegs are capable of maintaining alignment of the vacuum holes in the sanding disc during application.

4. The system of claim 1, wherein the table includes brackets to adjust an angle of the top of the table relative to at least one side of the table.

5. The system of claim 1, wherein the datum pegs may be positioned in a plurality of positions on the table.

6. The system of claim 1, further comprising a sanding disc storage station on the table configured to hold at least one sanding disc.

7. The system of claim 6, wherein the sanding disc storage station comprises a central spindle extending from the top of the table and through a central hole of the at least one sanding disc.

8. The system of claim 6, wherein the sanding disc storage station is adjacent to the application station, and wherein the sanding disc storage station and the application station are each configured to receive the same sanding disc.

9. The system of claim 1, further comprising a sander storage station on said table, said sander storage station comprising a holder capable of holding the hand sander having the sander pad.

10. The system of claim 9, wherein the holder includes a lip capable of holding the sander pad against the top of the table.

11. The system of claim 9, wherein the holder is semicircular and capable of having the hand sander hang within the holder.

12. The system of claim 9, wherein the holder is adjustable to receive differently shaped hand sanders.

13. A system comprising:

a hand sander including a sander pad having at least two datum notches defined in an outer perimeter of the sander pad; and a sanding disc fixture for attaching a sanding disc to the hand sander, the sanding disc fixture comprising:

a table having a top;

a sanding disc storage station on the table, the sanding disc storage station having a central spindle extending from the top of the table, the central spindle holding a stack of sanding discs with the central spindle extending through a central hole of each sanding disc; and an application station on the table, the application station having at least two datum pegs extending from the top of the table, the datum pegs holding a stack of sanding discs with attaching sides of the sanding discs facing away from the top of the table for attachment to the hand sander, the datum pegs passing through datum holes in the sanding discs to align the sanding discs with the sander pad when the sander pad is pressed against the attaching side of the outermost sanding disc, wherein the at least two datum pegs are oriented to receive the sander pad via side loading such that datum surfaces of the at least two datum pegs are received in the datum notches defined in the outer perimeter of the sander pad.

14. The system of claim 13, wherein the sanding discs have vacuum holes aligned with vacuum holes in the sander pad by the datum pegs.

15. The system of claim 13, further comprising a sander storage station on said table, said sander storage station comprising a holder holding the hand sander having the sander pad on said top of said table.

16. A method of attaching a sanding disc to a hand sander comprising:

providing at least two datum pegs extending from a top of a table;

positioning a sanding disc with the at least two datum pegs extending through corresponding datum holes in the sanding disc, the sanding disc being positioned with an attaching side of the sanding disc facing away from the top of the table;

aligning a hand sander with the sanding disc by pressing the hand sander against the at least two datum pegs such that corresponding datum notches in an outer perimeter of a sander pad of the hand sander each receive a corresponding one of the at least two datum pegs; and sliding the hand sander toward the top of the table along the at least two datum pegs until the sanding pad is pressed against the attaching side of the sanding disc.

17. The method of claim 16, wherein said aligning a hand sander comprises side-loading the hand sander into the application station in a direction non-parallel to the datum pegs.

* * * * *